US007395810B2

(12) United States Patent
Miyashita et al.

(10) Patent No.: US 7,395,810 B2
(45) Date of Patent: Jul. 8, 2008

(54) ENGINE START CONTROL APPARATUS

(75) Inventors: Kazumi Miyashita, Wako (JP); Kazutomo Nishida, Wako (JP); Toshikazu Nakamura, Wako (JP); Toru Taniguchi, Wako (JP); Hiroshi Mochizuki, Mitaka (JP)

(73) Assignees: Honda Motor Co., Ltd., Tokyo (JP); Iida Denki Kogyo Co., Ltd., Tokyo (JP)

( * ) Notice: Subject to any disclaimer, the term of this patent is extended or adjusted under 35 U.S.C. 154(b) by 0 days.

(21) Appl. No.: 11/710,499

(22) Filed: Feb. 26, 2007

(65) Prior Publication Data

US 2007/0204833 A1 Sep. 6, 2007

(30) Foreign Application Priority Data

Mar. 1, 2006 (JP) ..... 2006-055246

(51) Int. Cl.
*F02P 9/00* (2006.01)
*F02N 11/08* (2006.01)

(52) U.S. Cl. ..... 123/406.13; 123/406.53; 123/179.5

(58) Field of Classification Search ..... 123/406.13, 123/406.53, 179.5
See application file for complete search history.

(56) References Cited

U.S. PATENT DOCUMENTS 2,222,568 A * 11/1940 Newton ..... 123/179.5
3,554,176 A * 1/1971 Melloni ..... 123/179.5
4,895,120 A * 1/1990 Tobinaga et al. ..... 123/406.13
4,966,115 A * 10/1990 Ito et al. ..... 123/406.13
5,195,476 A * 3/1993 Schwarz ..... 123/179.5
6,148,777 A * 11/2000 Motose et al. ..... 123/406.13

FOREIGN PATENT DOCUMENTS

JP 03206357 A * 9/1991
JP 8-247012 A 9/1996

* cited by examiner

*Primary Examiner*—Stephen K. Cronin
*Assistant Examiner*—Arnold Castro
(74) *Attorney, Agent, or Firm*—Westerman, Hattori, Daniels & Adrian, LLP.

(57) ABSTRACT

Oil level detection sensor detects an oil level in a crankcase. First charging circuit includes a serial connection of a first charging capacitor for charging a reverse voltage produced in a primary coil, the detection sensor, and a first diode. Thyristor is turned on, in response to voltage-charging of the first charging capacitor, to disable an ignition operation of an ignition circuit. Second charging circuit includes a serial connection of a second charging capacitor for charging a forward voltage, produced in the primary coil, and a second diode. Transistor is turned on, in response to voltage-charging of the second charging capacitor, to disable a turning-on operation of the thyristor.

4 Claims, 3 Drawing Sheets

ENGINE START CONTROL APPARATUS

FIELD OF THE INVENTION

The present invention relates to engine start control apparatus for controlling start-up or activation of engines mounted on various loads, such as working machines, on the basis of levels of engine-lubricating oil.

BACKGROUND OF THE INVENTION

As an engine lubrication technique, there has been popularly employed a technique of lubricating various sliding portions with oil stored in a crankcase (hereinafter referred to as "oil-storage type" engine lubrication technique). With engines employing such an oil-storage type engine lubrication technique (i.e., oil-storage type engines), it is required that an amount or level of stored oil be proper, in order to smoothly lubricate various sliding portions of the engine.

Various oil level detection devices have been known, for example, from Japanese Patent Publication No. SHO-53-44615. The conventional oil level detection device disclosed in the No. SHO-53-44615 publication is provided in a vehicular engine and includes a float switch. When a level of stored oil has decreased or lowered to a preset lower limit level, the device detects the oil level lowering to the lower limit level by the float switch detecting the float having lowered together with the oil level, so that an oil-level warning can be generated by an alarm unit, such as a lamp or buzzer. But, because the disclosed conventional oil level detection device is constructed to only generate an oil-level warning, the engine still remains operative despite the oil level lowering to the lower limit level.

For enhanced durability of the engine, it is conceivable to more positively cope with the oil level lowering, e.g. by positively deactivating the engine upon detection of the oil level lowering to the lower limit level. Namely, arrangements may be made to positively prevent start-up of the engine if the oil is insufficient at the time of the engine start-up. In such a case, however, there arises a need to substantively simplify the overall construction of the oil level detection device and apparatus provided with the detection device.

SUMMARY OF THE INVENTION

In view of the foregoing prior art problems, it is an object of the present invention to enhance the durability of an oil-storage type engine using an engine start control apparatus of a simple construction.

In order to accomplish the above-mentioned object, the present invention provides an improved engine start control apparatus, which comprises: a float-type oil level detection sensor for generating an oil-level-lowering detection signal by detecting when a level of oil stored in a crankcase of an engine has lowered to a preset lower limit level; an ignition circuit for performing an ignition operation by controlling an ignition coil, connected to an ignition plug, to cause the ignition plug to produce a spark discharge; and a control section for controlling the ignition circuit in accordance with a detection signal output by the float-type oil level sensor. In the present invention, the control section includes: a first charging circuit comprising a serial connection of: a first charging capacitor for charging a reverse voltage produced in a primary coil of the ignition coil; the float-type oil level detection sensor; and a first diode; a first switching element that is turned on, in response to voltage-charging of the first charging capacitor, to disable the ignition operation of the ignition circuit; a second charging circuit including a serially-connected structure that includes: a second charging capacitor for charging a forward voltage produced in the primary coil of the ignition coil; and a second diode; and a second switching element that is turned on, in response to voltage-charging of the second charging capacitor, to disable an turning-on operation of the first switching element.

Namely, the basic principles of the present invention are based on behavior of the float that depends on the surface level of the oil differing between a time when the engine is at rest and a time when the engine is in operation. More specifically, when the engine is at rest, the oil surface level and hence the float does not change, while, when the engine is in operation, the oil surface level and hence the float changes greatly.

When the float-type oil level detection sensor has detected level lowering of the oil at start-up of the engine, the first switching element is turned on or triggered in response to voltage-charging of the first charging capacitor. In this way, the first switching element disables the ignition operation of the ignition circuit, to thereby prevent activation of the engine. Because such an arrangement permits activation of the engine only when the stored oil is sufficient, the present invention allows various sliding portions of the engine to be lubricated smoothly, as a result of which sufficient durability of the engine can be secured.

Once the engine is activated or started up when the level of the oil is appropriate, the second switching element is turned on or triggered in response to voltage-charging of the second charging capacitor. In this way, the second switching element disables turning-on of the first switching element. Thus, the first switching element can not disable the ignition operation of the ignition circuit, as a result of which the engine can remain operative. Because, in this case, a sufficient amount of the oil is stored in a crankcase of the engine, the engine can be reliably prevented from being undesirably deactivated due to violent and great fluctuation of the surface of the oil while the engine is in operation. As a result, the present invention can effectively enhance the workability of a load (to which the engine power is delivered), such as a working machine, having the engine mounted thereon.

Namely, the present invention allows the engine to be activated and deactivated with an enhanced reliability and ease on the basis of two conditions, i.e. rotation of the engine and level lowering of the oil.

Further, according to the present invention, the oil level has to be checked after a fill opening is opened, only when the engine is at rest, i.e., not in operation. Therefore, the frequency with which the fill opening is to be opened can be reduced significantly, Thus, even where the engine is used in an environment where dust and other foreign matters may easily enter through the fill opening, the present invention can minimize unwanted entry of dust and other foreign matters. Further, because the control section is connected only to the float-type oil level detection sensor and ignition circuit, the engine start control apparatus of the present invention can be significantly simplified in construction. As a result, the present invention can enhance the durability of the oil-storage type engine with a simple construction.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
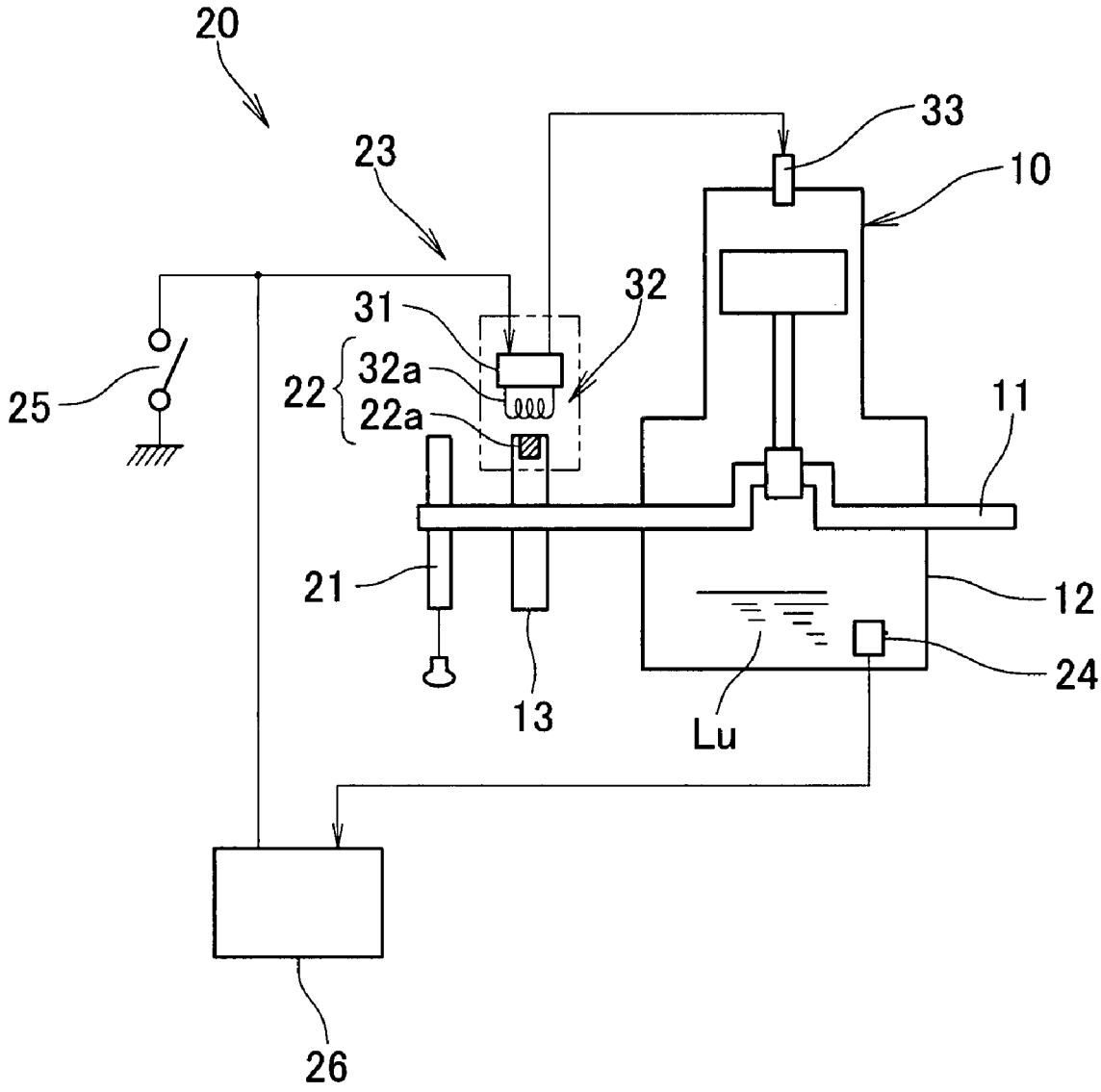
FIG. 1 is a block diagram schematically showing an engine and an engine start control apparatus according to an embodiment of the present invention.

Reference is initially made to FIG. 1 schematically showing an engine and an engine start control apparatus according to an embodiment of the present invention. The engine 10 is a single-cylinder internal combustion engine of an oil lubrication type, which includes a substantially-horizontal crankshaft 11, a crankcase 12 and a recoil starter 21, and in which various sliding portions are lubricated with oil Lu stored in the crankcase 12. The engine 10 is suited for mounting on various loads, such as a working machine.

The engine start control apparatus 20 for controlling start-up or activation of the engine 10 includes a power generator 22, an ignition device 23, a float-type oil level detection sensor 24, a main switch 25, and a control section 26. Note that this engine start control apparatus 20 does not include a battery.

The recoil starter 21 is a starting device that allows a human operator to manually activate the engine 10, and it is provided, for example, on the crankshaft 11 or flywheel 13.

The power generator 22 includes a permanent magnet 22*a* provided on the flywheel 13 connected directly to the crankshaft 11, and a primary coil 32*a* positioned adjacent to the permanent magnet 22*a*.

The ignition device 23 includes an ignition circuit 31, an ignition coil 32 and an ignition plug 33. This ignition device 23 is of a magnet-based generating type (flywheel-magnet ignition type), which directly uses the electric power, generated by the generator 22, as a primary power for the ignition coil 32 without storing the generator-generated power in a battery. Namely, in the ignition device 23, electric power is produced in the primary coil 32*a* responding to the magnetism of the rotating permanent magnet 22*a*, and the thus-produced power is used as primary power for the ignition coil 32.

To perform ignition, the ignition circuit 31 causes the ignition plug 33 to produce a spark discharge by controlling the ignition coil 32 connected to the ignition plug 33.

Figure 3:
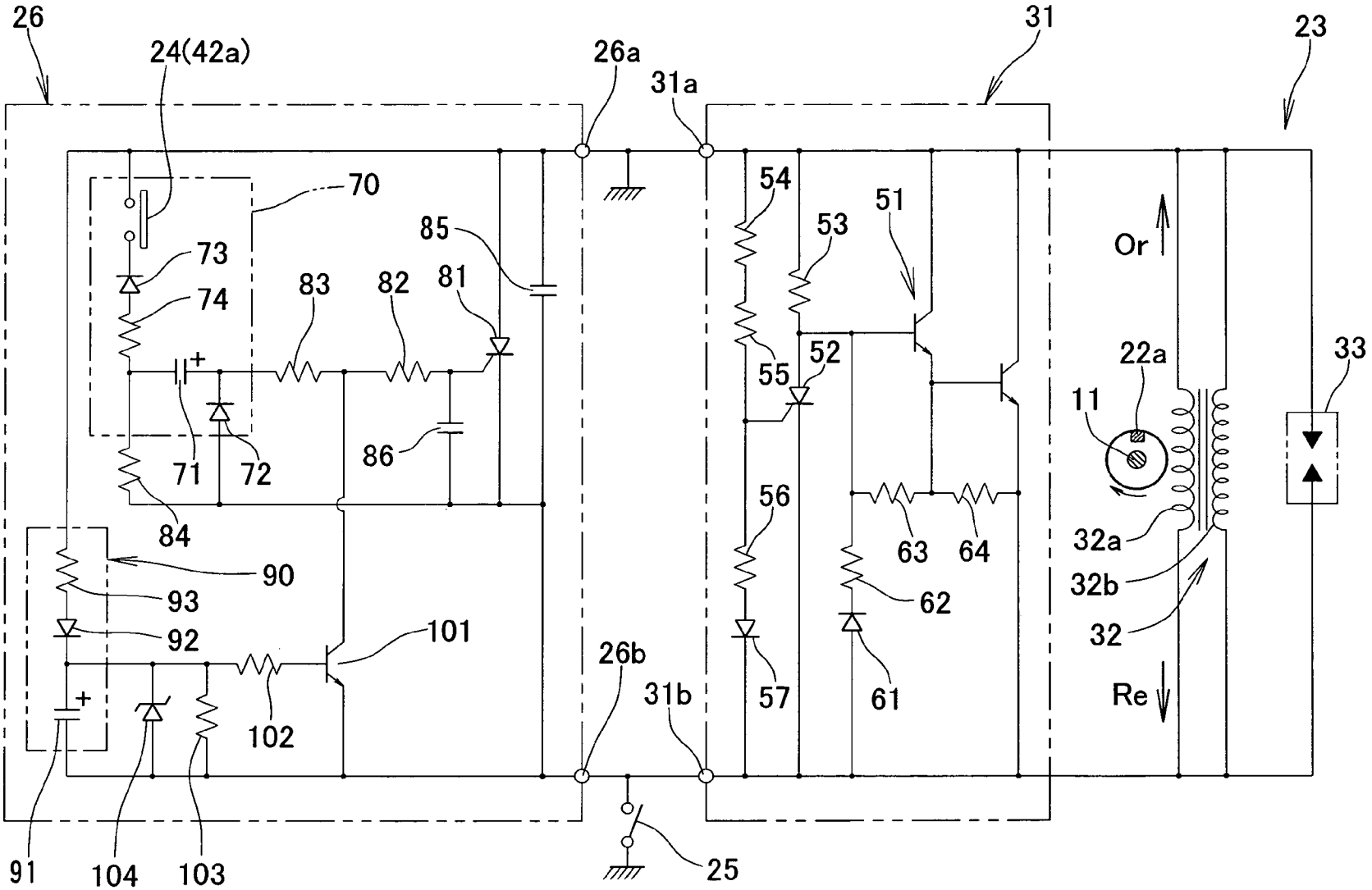
FIG. 3 is a circuit diagram of the engine start control apparatus.

The ignition coil 32 comprises the primary coil 32*a* and secondary coil 32*b* (FIG. 3). High-voltage intermittent currents are supplied to the ignition plug 33.

The main switch 25 is a main power switch manually operable by the human operator to activate or deactivate the engine 10, and it supplies a switch signal, corresponding to the human operator's operation, to the control section 26. The main switch 25 has a normally-open contact that is turned off when the engine 10 is to be activated and turned on when the engine 10 is to be deactivated.

The control section 26 performs control on the ignition circuit 31 in response to various detection signals of the float-type oil level detection sensor 24, details of which will be later discussed.

The float-type oil level detection sensor (i.e., oil alert) 24 is provided to constantly detect a level of the oil Lu stored in the crankcase 12. Details of the float-type oil level detection sensor 24 will be discussed with reference to FIGS. 2A and 2B.

Figure 2B:
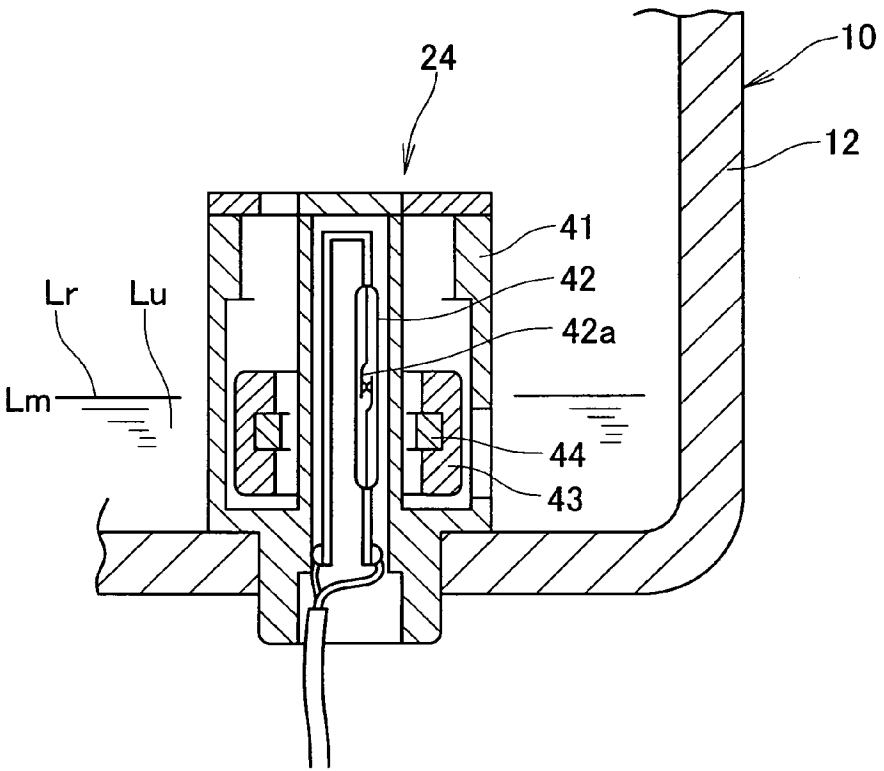
FIGS. 2A and 2B are views explanatory of a construction and behavior of relevant sections of a float-type oil level detection sensor in the engine start control apparatus of FIG. 1.
Figure 2A:
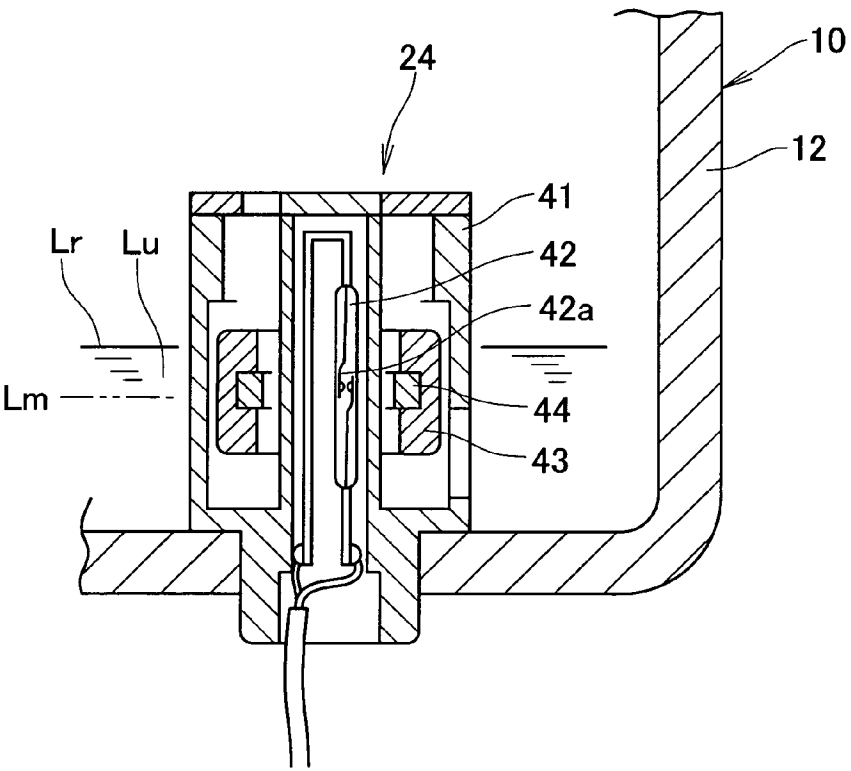

FIGS. 2A and 2B are views explanatory of a construction and behavior of principal sections of the float-type oil level detection sensor (i.e., oil alert) 24 employed in the instant embodiment. More specifically, FIG. 2A shows a sectional construction of the principal sections of the float-type oil level detection sensor 24 when a sufficient amount of the oil Lu is stored above a lower limit level Lm, while FIG. 2B shows a sectional construction of the principal sections of the detection sensor 24 when the oil Lu has decreased or lowered to the lower limit level Lm.

The float-type oil level detection sensor (i.e., oil alert) 24 includes a case 41 mounted in the crankcase 12, and a reed switch 42 and float 43 accommodated in the case 41. The reed switch 42 has a normally-open contact 42*a* and is positioned in a substantial vertical orientation. The float 43 has an annular (or ring) shape and floats on the surface of the oil so as to move vertically (i.e., descend and ascend) in accordance with (or following) the oil surface. The float 43 has an annular permanent magnet 44 provided on and along its inner circumference and is vertically movable with the reed switch 42 located centrally therein.

The following paragraphs describe behavior of the float-type oil level detection sensor 24.

While the oil Lu is stored sufficiently above the lower limit level Lm as shown in FIG. 2A, the float 43 keeps floating on the oil surface. In this state, the normally-open contact 42*a* of the reed switch 42 is kept opened (i.e., kept in a switch-off position) without being influenced by the magnetism of the permanent magnet 44. Consequently, the float-type oil level detection sensor 24 is kept OFF.

Then, as the surface of the oil Lu lowers to the lower limit level Lm as shown in FIG. 2B, the float 43 descends to a lower position within the case 41, so that the permanent magnet 44 descends away from the normally-open contact 42*a* of the reed switch 42. Thus, the normally-open contact 42*a* of the reed switch 42 is closed (i.e., inverted to a switch-on position) by being influenced by the magnetism of the permanent magnet 44. Consequently, the float-type oil level detection sensor 24 is turned on to thereby generate a level lowering detection signal.

Namely, when an actual level Lr of the oil Lu (i.e., actual oil surface level Lr) has lowered to the lower limit level Lm at which the normally-open contact 42*a* of the reed switch 42 is inverted to the switch-on position, the float-type oil level detection sensor 24 generate a level lowering detection signal.

FIG. 3 is a circuit diagram of the engine start control apparatus of the present invention.

First, the ignition circuit 31 is described. The ignition circuit 31 is an induced-discharge type ignition circuit 31 which includes a transistor circuit 51 having its collector-emitter path connected between two terminals of the primary coil 32*a*, and a thyristor 52 connected in parallel to the transistor circuit 51. The transistor circuit 51 is, for example, in the form of a Darlington circuit.

Anode of the thyristor 52 is not only connected, via a resistor 53, to the collector of the transistor circuit 51 but also connected to the base of the transistor circuit 51. Cathode of the thyristor 52 is connected to the emitter of the transistor circuit 51.

Gate of the thyristor 52 is connected to the collector of the transistor circuit 51 via a serial circuit of a variable resistor 54 and resistor 55, and to the emitter of the transistor circuit 51 via a serial circuit of a resistor 56 and diode 57. The diode 57 is provided for temperature compensation of a gate voltage of the thyristor 52.

Serial circuit of a diode 61 and resistor 62 connected to an emitter-collector path is a pre-ignition prevention circuit in the ignition circuit 31; the anode and cathode of the diode 61 are oriented in an opposite direction to those of the diode 57.

Resistors 63 and 64 are connected respectively to base-emitter paths of two transistors constituting the Darlington circuit.

In the ignition circuit 31 thus arranged, the transistor circuit 51 is brought to a conduction state (i.e., turned on) as a positive voltage of a forward direction (i.e., positive voltage of a direction of arrow Or, which will hereinafter be referred to as "forward voltage") rises in the primary coil 32*a* responding to the magnetism of the permanent magnet 22*a* that rotates with the crankshaft 11 rotated via the recoil starter 21 (FIG. 1). Consequently, a primary short-circuit current flows through the transistor circuit 51, at which time the thyristor 52 is biased in the forward direction.

Then, as the induced voltage in the primary coil 32*a* increases and thus the primary short-circuit current increases, the gate potential of the thyristor 52 reaches a trigger gate potential so that the thyristor 52 is triggered. In this manner, the thyristor 52 is turned on.

Once the thyristor 52 is turned on, the base potential of the transistor circuit 51 lowers, relative to the emitter potential of the transistor circuit 51, to such an extent that the conduction state of the transistor circuit 51 can not be maintained any more. As a consequence, the transistor circuit 51 is turned off, so that the primary short-circuit current, having so far been flowing through the primary coil 32*a*, is shut off abruptly. Because of the shutoff of the primary short-circuit current, a high voltage is induced in the secondary coil 32*b*, so that ignition is effected by a spark discharge being produced in the ignition plug 33.

The ignition circuit 31 includes a first terminal 31*a* to which is applied the forward voltage produced by the primary coil 32*a*, and a second terminal 31*b* to which is applied a positive voltage of a reverse direction (i.e., positive voltage of a direction of arrow Re in FIG. 3, which will hereinafter be referred to as "reverse voltage") produced by the primary coil 32*a*. The first terminal 31*a* is a plus-side terminal connected not only to a first terminal 26*a* of the control section 26 but also to the ground. The second terminal 31*b* is a minus-side terminal connected not only to a second terminal 26*b* of the control section 26 but also to the ground via the main switch 25. Note that the collector of the transistor circuit 51 and anode of the thyristor 52 are connected to the second terminal 31*b*.

Needless to say, the first and second terminals 31*a* and 31*b* of the ignition circuit 31 have the following potentials while the main switch 25 is in the OFF position. When the forward voltage has been applied to the first terminal 31*a*, the first terminal 31*a* has the ground potential while the second terminal 31*b* has a minus potential. When the reverse voltage has been applied to the second terminal 31*b*, the first terminal 31*a* has the ground potential while the second terminal 31*b* has a plus potential.

As further shown in FIG. 3, the control section 26 includes a first charging circuit 70, first switching element 81, second charging circuit 90, and second switching element 101.

The first charging circuit 70 is a serial circuit including a first charging capacitor 71 for charging the reverse voltage produced by the primary coil 32*a*, the float-type oil level detection sensor 24 (more specifically, normally-open contact 42*a*) and a pair of reverse-flow preventing first diodes 72 and 73.

More specifically, the first charging circuit 70 includes, in a section from the second terminal 26*b* to the first terminal 26*a* (i.e., ground terminal 26*a*), the reverse-flow preventing diode 72, first charging capacitor 71, current-limiting resistor 74, reverse-flow preventing diode 73 and float-type oil level detection sensor 24, which are connected in series in the order mentioned.

The first switching element 81, which is for example in the form of a thyristor, is turned on or triggered in response to charging of the first charging capacitor 71, to disable the ignition operation of the ignition circuit 31.

Gate of the thyristor 81 is connected to a plus-side electrode of the first charging capacitor 71 via a gate-protecting resistor 82 and discharge-circuit-forming resistor 83. Anode of the thyristor 81 is connected to the first terminal 26*a*. Cathode of the thyristor 81 is connected to the second terminal 26*b*, as well as to a minus-side electrode of the first charging capacitor 71 via a discharge-circuit-forming resistor 84.

Namely, the thyristor 81, which is provided in the discharge circuit for the first charging capacitor 71, is triggered once the charged voltage in the first charging capacitor 71 exceeds a predetermined level, so as to disable the ignition operation of the ignition circuit 31.

Capacitor 85 connected in parallel to the thyristor 81 is intended to prevent the thyristor 81 from malfunctioning due to a pulsed surge voltage. Capacitor 86 connected to a gate-cathode path of the thyristor 81 is intended to stabilize the gate of the thyristor 81.

The second charging circuit 90 is a serial circuit including a second charging capacitor 91 for charging the forward voltage produced by the primary coil 32*a*, and second diode 92.

More specifically, the second charging circuit 90 includes, in a section from the first terminal 26*a* to the second terminal 26*b*, a current-limiting resistor 93, reverse-flow preventing diode 92 and second charging capacitor 91, which are connected in series in the order mentioned.

The second switching element 101, which is for example in the form of a NPN transistor, is triggered in response to voltage-charging of the second charging capacitor 91, to disable the turning-on of the first switching element 81.

Base of the transistor 101 is connected to a plus-side electrode of the second charging capacitor 91 via a base-protecting resistor 102. Collector of the transistor 101 is connected to the gate of the thyristor 81 via the transistor 82. Emitter of the transistor 101 is connected to the second terminal 26*b*, as well as to a minus-side electrode of the second charging capacitor 91.

Namely, the transistor 101, which is provided in the discharge circuit for the second charging capacitor 91, is triggered once the charged voltage in the second charging capacitor 91 exceeds a predetermined level, so as to disable the turning-on operation of the thyristor 81.

Note that a resistor 103 connected to a base-emitter path of the transistor 101 is intended to stabilize the operation of the transistor 101. Zener diode 104 connected in parallel to the second charging capacitor 91 is intended to set a charging voltage of the second charging capacitor 91.

The following paragraphs describe behavior of the engine start control apparatus 20 constructed in the above-described manner.

When the actual level Lr of the oil Lu is in the lowered position, i.e., when the oil Lu is insufficient, as shown in FIG. 2B, the float-type oil level detection sensor 24 takes the ON position. In this state, the main switch 25 is operated to activate the engine 10 (i.e., to bring the normally-open contact to the OFF or disconnected position) and then the recoil starter 21 is activated, in response to which the crank shaft 11 starts rotating.

Because the float-type oil level detection sensor 24 is ON at this stage, the first charging circuit 70 of FIG. 3 is in the closed state. Portion of a reverse voltage induced in the primary coil 32*a* is charged, in a polarity shown in the figure, into the first charging capacitor 71, so that the thyristor 81 is triggered or turned on. With the thus turned-on thyristor 81, the two terminals of the primary coil 32*a* inducing a forward voltage are short-circuited, so that the ignition circuit 31 is unable to perform the ignition and thus start-up of the engine 10 is prevented.

Namely, the ignition plug 33 is not ignited as long as the oil Lu is insufficient. Once the engine start-up operation via the recoil starter 21 (FIG. 1) is terminated, the crankshaft 11 is deactivated. Namely, the engine 10 will not start its operation as long as the oil Lu is insufficient.

Further, while the thyristor 81 is short-circuiting the two terminals of the primary coil 32*a*, the forward voltage between the first and second terminals 26*a* and 26*b* is kept at a low level. Thus, even if a portion of the forward voltage is supplied to the second charging capacitor 91 to charge the capacitor 91, the charged voltage is extremely small, and thus triggering, by the second charging capacitor 91, of the transistor 101 is not permitted. Also, even if the transistor 101 can be triggered by the second charging capacitor 91, the transistor 101 will operate only for an extremely short time, and thus, the transistor 101 can not disable triggering of the thyristor 81.

Then, as the crankcase 12 is replenished with additional oil Lu after the main switch 25 is operated to deactivate the engine 10 (i.e., to bring the normally-open contact to the ON or connected position), the actual oil level Lr reached an appropriate level. Thus, the float-type oil level detection sensor 24 is brought to the OFF state.

After that, the main switch 25 is operated to activate the engine 10 (i.e., to bring the normally-open contact to the OFF or disconnected position) and then recoil starter 21 is activated, in response to which the crankshaft 11 starts rotating.

At that stage, the first charging circuit 70 is in the open state because the float-type oil level detection sensor 24 is in the OFF state, as shown in FIG. 3. Because no reverse voltage is supplied to the first charging capacitor 71 to charge the capacitor 71, the thyristor 81 is kept in the OFF state without being triggered. Therefore, a forward voltage is induced in the primary coil 32*a* in a normal manner, so that the ignition circuit 31 performs the ignition operation and thus the engine 10 is activated or started up. Because a portion of the forward voltage produced in the first primary coil 32*a* is supplied to the second charging capacitor 91, by way of the second charging circuit 90, to charge the capacitor 91, the transistor 101 is triggered or turned on.

Once the actual level Lr of the oil Lu lowers as shown in FIG. 2B after completion of the activation of the engine 10, e.g. after the engine 10 has been brought to a no-load idling state, the float-type oil level detection sensor 24 is again turned on, in response to which the first charging circuit 70 is closed and a reverse voltage is supplied to the first charging capacitor 71 to charge the capacitor 71.

However, because the transistor 101 is kept in the ON state, the reverse voltage charged in the first charging capacitor 71 flows from the transistor 101 to the second terminal 26*b*, so that the thyristor 81 is kept in the OFF state without being triggered. Consequently, the ignition plug 33 continues to perform the ignition operation irrespective of the actual oil level Lr, and thus, the engine 10 can remain operative without a hitch.

Then, once the main switch 25 is operated to deactivate the engine 10 (i.e., to bring the normally-open contact to the ON or connected position), the ignition plug 33 stops its ignition operation, as a result of which the engine 10 is deactivated.

The following paragraphs sump up the foregoing explanation.

The present invention focuses on (i.e., the basic principles of the present invention are based on) the behavior of the float 43 that depends on the surface level of the oil Lu differing between the time when the engine 10 is at rest and the time when the engine 10 is in operation. Namely, when the engine 10 is at rest, the oil surface level does not vary, while, when the engine 10 is in operation, the oil surface level varies greatly.

When the float-type oil level detection sensor 24 has detected level lowering of the oil Lu at start-up of the engine 10, the first switching element 81 is turned on by being triggered in response to voltage-charging in the first charging capacitor 71. In this way, the first switching element 81 disables the ignition operation of the ignition circuit 31, to thereby prevent activation of the engine 10. Because the engine 10 is activated only when the stored oil Lu is sufficient, the instant embodiment allows various sliding portions of the engine 10 to be lubricated smoothly, as a result of which sufficient durability of the engine 10 can be achieved.

Once the engine 10 is activated when the level of the oil Lu is appropriate, on the other hand, the second switching element 101 is turned on by being triggered in response to voltage-charging in the second charging capacitor 91. In this way, the second switching element 101 disables turning-on of the first switching element 81, so that the first switching element 81 can not disable the ignition operation of the ignition circuit 31. As a result, the engine 10 can remain operative.

Because, in this case, a sufficient amount of the oil Lu is stored in the crankcase 12, the engine 10 can be reliably prevented from being accidentally deactivated due to violent and great fluctuation of the surface of the oil Lu during operation. As a result, the instant embodiment can significantly enhance the workability of the load, such as a working machine, having the engine 10 mounted thereon.

As apparent from the foregoing, the instant embodiment allows the engine 10 to be activated and deactivated appropriately with an enhanced reliability and ease on the basis of two activating/deactivating conditions, i.e. rotation of the engine 10 and level lowering of the oil Lu.

Furthermore, only when the engine 10 is at rest, the instant embodiment requires the oil level to be checked after opening of a fill opening. Therefore, the frequency with which the fill opening should be opened can be minimized. Thus, even in an undesired environment where dust and other foreign matters can easily enter through the fill opening, the instant embodiment can significantly reduce entry of dust and other foreign matters.

Further, because the control section 26, comprising a combination of the two charging circuits 70 and 90 and two switching elements 81 and 101, is connected only to the float-type oil level detection sensor 24 and ignition circuit 31, the engine start control apparatus 20 can be greatly simplified in construction.

Note that the starter in the embodiment of the present invention is not necessarily limited to the recoil starter 21 and it may be a self-starter.

When the stored oil Lu is insufficient while the engine 10 is at rest or not operating, the engine start control apparatus 20 of the present invention performs control to prevent activation of the engine 10. But, during operation of the engine 10, the engine start control apparatus 20 performs control to continue the operative state of the engine 10 irrespective of the level of the oil Lu.

Thus, the engine start control apparatus of the present invention is highly suited to control engines mounted on various working machines, such as rammers and other construction working machines and bush/grass cutting machines, which tend to be subjected to violent and great variation of the surface of oil Lu and/or tend to temporarily incline greatly during operation. Also, the engine start control apparatus of the invention is suited to control engines mounted on various traveling loads, such as utility vehicles and racing carts in amusement parks.

Obviously, various minor changes and modifications of the present invention are possible in light of the above teaching. It is therefore to be understood that within the scope of the appended claims the invention may be practiced otherwise than as specifically described.

What is claimed is:

1. An engine start control apparatus comprising:

a float-type oil level detection sensor for generating an oil-level-lowering detection signal by detecting when a level of oil stored in a crankcase of an engine has lowered to a preset lower limit level;

an ignition circuit for performing an ignition operation by controlling an ignition coil, connected to an ignition plug, to cause the ignition plug to produce a spark discharge; and a control section for controlling said ignition circuit in accordance with a detection signal output by said float-type oil level sensor, said control section including:

a first charging circuit comprising a serial connection of: a first charging capacitor for charging a reverse voltage produced in a primary coil of the ignition coil; said float-type oil level detection sensor; and a first diode;

a first switching element that is turned on, in response to voltage-charging of said first charging capacitor, to disable the ignition operation of said ignition circuit;

a second charging circuit comprising a serial connection of: a second charging capacitor for charging a forward voltage produced in the primary coil of the ignition coil; and a second diode; and a second switching element that is turned on, in response to voltage-charging of said second charging capacitor, to disable an turning-on operation of said first switching element.

2. The engine start control apparatus of claim 1, wherein said first switching element is connected in parallel to said ignition circuit.

3. The engine start control apparatus of claim 1, wherein said ignition circuit includes a transistor circuit connected in parallel to the primary coil, and a thyristor connected to a base of the transistor circuit, and said first switching element is connected in parallel to the thyristor.

4. The engine start control apparatus of claim 1, wherein said second switching element comprises a transistor connected to a gate-cathode path of said first switching element.

* * * * *